United States Patent [19]

Hartness

[11] Patent Number: 4,833,860

[45] Date of Patent: May 30, 1989

[54] GRID STRUCTURE

[75] Inventor: Robert G. Hartness, Greer, S.C.

[73] Assignee: Hartness International, Greenville, S.C.

[21] Appl. No.: 139,325

[22] Filed: Dec. 30, 1987

Related U.S. Application Data

[63] Continuation-in-part of Ser. No. 13,008, Feb. 10, 1987, Pat. No. 4,726,167, and a continuation-in-part of Ser. No. 33,455, Apr. 1, 1987, abandoned.

[51] Int. Cl.[4] ..... B65B 39/02; B65B 35/32

[52] U.S. Cl. ..... 53/261; 53/539

[58] Field of Search ..... 53/248, 247, 260, 261, 53/262, 543, 539

[56] References Cited

U.S. PATENT DOCUMENTS

| | | | |
|---|---|---|---|
| 2,656,081 | 10/1953 | Davis | 226/14 |
| 3,031,820 | 5/1962 | Schulze et al. | 53/247 |
| 3,057,136 | 10/1962 | Walter | 53/262 |
| 3,271,928 | 9/1966 | Wild | 53/248 |
| 3,325,967 | 6/1967 | Wild | 53/539 X |
| 3,353,331 | 11/1967 | Rowekamp | 53/539 |
| 3,570,216 | 3/1971 | Frentzel | 53/248 |
| 3,673,756 | 7/1972 | Prete et al. | 53/61 |
| 3,788,034 | 1/1974 | Hartness et al. | 53/248 |
| 3,826,382 | 7/1974 | Zappia | 53/543 X |
| 3,908,339 | 9/1975 | Kennedy et al. | 53/248 |
| 3,911,647 | 10/1975 | Hartness et al. | 53/248 |
| 3,965,650 | 6/1976 | Nussbaum | 53/539 |
| 4,044,530 | 8/1977 | Phillips | 53/248 |
| 4,048,783 | 9/1977 | Raudat et al. | 53/543 X |
| 4,075,819 | 2/1978 | Raudat et al. | 53/248 |
| 4,170,096 | 10/1979 | Wild | 53/248 |
| 4,171,603 | 10/1979 | Wiseman | 53/261 X |
| 4,207,721 | 6/1980 | Raudat et al. | 53/248 |
| 4,207,722 | 6/1980 | Raudat | 53/248 |
| 4,215,521 | 8/1980 | Hartness | 53/248 |
| 4,248,029 | 2/1981 | Hartness et al. | 53/248 |
| 4,581,872 | 4/1986 | Goodell | 53/262 X |
| 4,608,804 | 9/1986 | Wild | 53/262 |

*Primary Examiner*—Horace M. Culver

*Attorney, Agent, or Firm*—Dority & Manning

[57] ABSTRACT

A grid finger is disclosed which is attachable to a grid structure for guiding articles delivered to the grid structure from an article supply source into containers. The grid finger includes a compressible resilient member projecting from the upper end thereof. A grid finger receiving member defining a receiving recess receiving the upper end of the grid finger and the compressible resilient member is provided. The grid finger receiving member has portions defining an aperture for receiving the compressible resilient member such that the grid finger may be inserted into the receiving member in a correct orientation only. Also disclosed are grid structure guide members having oppositely angled upper portions which contact the lower surfaces of articles delivered to the grid structure for both separating articles and for guiding the articles into passages provided in the grid structure.

14 Claims, 4 Drawing Sheets

GRID STRUCTURE

This application is a continuation-in-part of co-pending U.S. patent application Ser. No. 07/013,008, filed Feb. 10, 1987, now U.S. Pat. No. 4,726,167 and co-pending U.S. patent application Ser. No. 07/033,455, filed Apr. 1, 1987, now abandoned.

BACKGROUND OE THE INVENTION

This invention relates to a grid finger attachable to a grid structure for guiding articles delivered to the grid structure into compartments of containers. This invention also relates to a grid structure for use with a case packing machine, wherein the grid structure has grid fingers movable by grid finger actuators.

Case packing machines for packing aligned rows of containers into compartmentalized cases typically employ conveyors for delivering the containers from an upstream source of containers to a grid structure. The grid structure generally includes partitions arranged to form passages which correspond to compartments in the cases which are to be packed. Grid structures are often provided with yieldable grid fingers which extend downwardly from the sides of the grid structure passages for projecting into the compartments of an empty case to guide and retard the movement of the containers as the containers pass through the grid structure into the empty case. Upon delivery from the conveyor to the grid structure, the containers are positioned in the passages of the grid structure, and the grid structure is lowered with the containers to an empty case for loading the containers into a case, or the empty case may be brought upwards to the grid structure, depending on the design of the particular case packing machine.

Generally, the containers are held in the grid structure prior to being delivered to the compartments of the case by laterally shiftable rods, such as disclosed in U.S. Pat. No. 2,656,081, granted to Davis and in U.S. Pat. No. 3,570,216, granted in Frentzel, or by pivotable doors, such as disclosed in U.S. Pat. No. 3,673,756, granted to Prete et al.

The conventional shiftable rod assemblies discussed above may provide a rigid impact surface against which containers are dropped when delivered to a grid structure. The dropping of the containers on such rigid structures increases: the likelihood of breakage or damage to the containers and also results in increased noise during operation of the case packing machine.

Further, use of the conventional shiftable rod assemblies for retaining containers within a grid structure also affects the thickness dimension of the partition walls of the grid structure. This is because as a grid structure is increased in length, the weight required to be supported by the shiftable rod assembly when the containers are resting thereon is correspondingly increased. This requires for the shiftable rod assembly to be strengthened, which results, normally, in the shiftable rod assembly being made of thicker profile. Since the conventional shiftable rod assembly shifts from a container restricting position, which is directly below the passages of the grid structure, to a container discharge position, which requires for the shiftable rod assembly to be beneath the partitions of the grid structure, the partitions of the grid structure must be at least as thick as the shiftable rods so that the containers may pass beside the shiftable rods as the containers are discharged through the passages of the grid structure. Consequently, in such situations the partition walls must be made thicker, causing the containers to be further separated from one another in the grid structure. This is undesirable in that for the tight packing of containers into a case, especially where the containers are square or rectangular shaped, the containers are required to be close together in the grid structure. Hence, the thicker partition walls make more difficult the loading into a case of such square or rectangular shaped containers. Furthermore, the requirement of making the partition walls thicker may increase the cost of the grid structure and the overall bulk thereof. Again, referring to the conventional shiftable rod assemblies discussed above, such mechanisms may require linkages and camming mechanisms which are both costly and complex in the operation thereof. This becomes even more important when it is taken into account that such assemblies are constantly subjected to the impact forces of containers being dropped thereon in the grid structure, thereby increasing the likelihood of damage thereto.

Other devices have been patented which selectively push the grid fingers below the grid structure together for preventing containers released from the passages of the grid structure from falling directly into the compartments of an empty case below. Such devices are disclosed in U.S. Pat. No. 4,215,521, granted to applicant's father Thomas S. Hartness, entitled, "Article Retarding Device For A Case Loading Machine" and in U.S. Pat. No. 4,248,029, granted to applicant and applicant's father, entitled, "Case Packer Loading Device".

Grid structures are often provided with yieldable grid fingers which extend downwardly from the sides of the grid structure compartments for projecting into the compartments of an empty case to guide and retard the movement of the containers as the containers pass through the grid structure and into the empty case. Sometimes, the grid fingers wear or may become bent or broken such that they must be replaced. Replacement of the fingers can be a time consuming, tedious endeavor if the fingers are not designed for quick installation and removal.

Several types of finger members have been patented which are designed for easier installation and removal from a grid structure. For example, U.S. Pat. No. 3,271,928, granted to Wild for a packer grid, discloses a grid finger member having a recessed portion for receiving a spring member attached to the grid structure. Installation of a finger involves inserting the finger into a bracket attached to the grid structure to a position such that the spring engages the recessed portion of the finger. Removal of the finger involves depressing the spring such that the spring becomes disengaged from the recessed portion, thereby allowing the finger to be pulled from the bracket. U.S. Patent No. 4,170,096, also granted to Wild, discloses another type of finger member having a longitudinal slot which engages cylindrical collars attached to the grid structure. The finger is retained to the grid structure through a releasable interference fit between the slot and the collars.

Other patented fingers are disclosed in patents having the following U.S. Pat. Nos. 3,031,820 granted to Schulze et al; 3,788,034 and 3,911,647 granted to Hartness et al., the present inventors; U.S. Pat. No. 4,044,530 granted to Phillips; and U.S. Pat. No. 4,075,819 and U.S. Pat. No. 4,207,721 granted to Raudat et al.

A problem exists with conventional grid fingers in that the grid finger attachment mechanism may have a pronounced profile or protuberances which project into the compartments of the grid structure in a manner which obstructs or inhibits the passage of or even damages the containers or the labels thereon as the containers pass through the grid structure. Such is especially significant where boxes are to be loaded into partitioned cases since the boxes must be maintained close together during packing into the case. Further, where loading rectangular containers or boxes into close-fitting partitions of a case, the grid fingers must be relatively thin for extending between the partition and the container or box being packed. Moreover, conventional grid finger attachments typically involve the use of a variety of parts, which increases the complexity of the assembly thereof.

Additionally, a problem may exist with certain grid fingers in that they may be inserted incorrectly into the grid structure, due to the design of the grid fingers which allows them to be readily attached to the grid structure in positions other than which are correct. This not only reduces the efficiency of the grid structure but also results in additional labor being required to correct the incorrect attachment of the grid fingers to the grid structure.

Referring to the grid structure itself, another problem occurs when the articles to be delivered to the grid structure are in contact with one another. This creates a problem of both separating and guiding the articles into separate compartments of the grid structure. Otherwise, the articles may hang-up in the grid structure, possibly causing the packing machine to jam.

SUMMARY OF THE INVENTION

The present invention recognizes and addresses such drawbacks of the prior art. Hence, it is a general object of the present invention to provide a grid structure having means for separating and guiding articles into passages of the grid structure.

Another object of the present invention is to provide a grid structure having grid fingers which are movable between an article retaining position for retaining articles in passages of the grid structure and an article discharging position for guiding the articles into cases which are to be packed.

Another object of the present invention is to provide an attachment for attaching a grid finger to a grid structure, the attachment being relatively low profile to allow containers to pass freely through passages of the grid structure in close relationship to one another.

Another object of the present invention is to provide an attachment for grid fingers which is of simple construction and which allows grid fingers to be quickly and easily installed in or removed from a grid structure.

Yet another object of the present invention is to provide an attachment for grid fingers which allows the grid fingers to be installed in a grid structure in a correct orientation only.

Still another object of the present invention is to provide a grid structure having a low profile attachment for grid fingers which allows grid fingers to be quickly and easily installed in and removed from the grid structure.

Still further, another object of the present invention is to provide a grid structure having partition walls configured for separating and guiding containers delivered to the grid structure into passages in the grid structure.

Various combinations of presently disclosed features may be provided in a given embodiment thereof in accordance with this invention. Generally, one such exemplary embodiment of the present invention includes a grid finger receivable in an opening of a grid structure for guiding articles delivered to a passage of the grid structure from an article supply source through the passage and into containers. The grid finger comprises an elongated body member having an upper end receivable in the opening of the grid structure adjacent the passage. A compressible resilient member is included which projects from the elongated body member proximate the upper end of the elongated body member. The compressible resilient member is receivable in and projectable through the opening of the grid structure only when the elongated body member is positioned for guiding articles delivered to the grid structure through the passage, such that upon receipt by the grid structure of the upper end of the elongated body member and the compressible resilient member, the compressible resilient member projects through the opening for fixedly retaining the elongated body member to the grid structure.

The present invention also includes a grid structure for use on a case packing machine for packing articles in aligned rows into cases. The grid structure comprises elongated members for allowing the articles to be positioned in aligned rows and are spaced apart sufficiently for allowing the articles to pass therebetween. Guide members are spaced along the elongated members for defining passages through which the articles may pass for loading into the cases.

The guide members include a first guide member positioned adjacent a first passage, the first guide member having a first portion and a second portion spaced from the first portion. The first guide member defines a first inclined portion extending upwardly from the first portion to the second portion of the first guide member. The guide members also include a second guide member spaced from the first guide member by the first passage. The second guide member has a first portion and a second portion spaced from the first portion thereof. The first and second portions of the second guide member are spaced across from the first and second portions of the first guide member, respectively, by the first passage. The second guide member defines a second inclined portion extending downwardly from the first portion of the second portion of the second guide member, such that when articles are supplied to the grid structure, the articles are contactable with the first and second inclined portions, whereby the articles are separated and guided into adjacent passages in the grid structure by the first and second inclined portions.

Downwardly extending grid fingers are provided which are attached adjacent the passages and movable between an article retaining position for retaining the articles in the passages and an article discharging position for allowing the articles to be discharged in aligned rows from the passages. Also, actuation means which are contactable with the grid fingers are provided for effecting movement of the grid fingers between the article retaining position and the article discharging position. The actuation means are actuatable to move the grid fingers between the article retaining position and the article discharging position.

BRIEF DESCRIPTION OF THE DRAWINGS

The foregoing as well as other objects of the present invention will be more apparent from the following detailed description of a preferred embodiment of the invention, including the best mode thereof, when taken together with the accompanying drawings, in which.

DESCRIPTION OF THE PREFERRED EMBODIMENT

Figure 1:
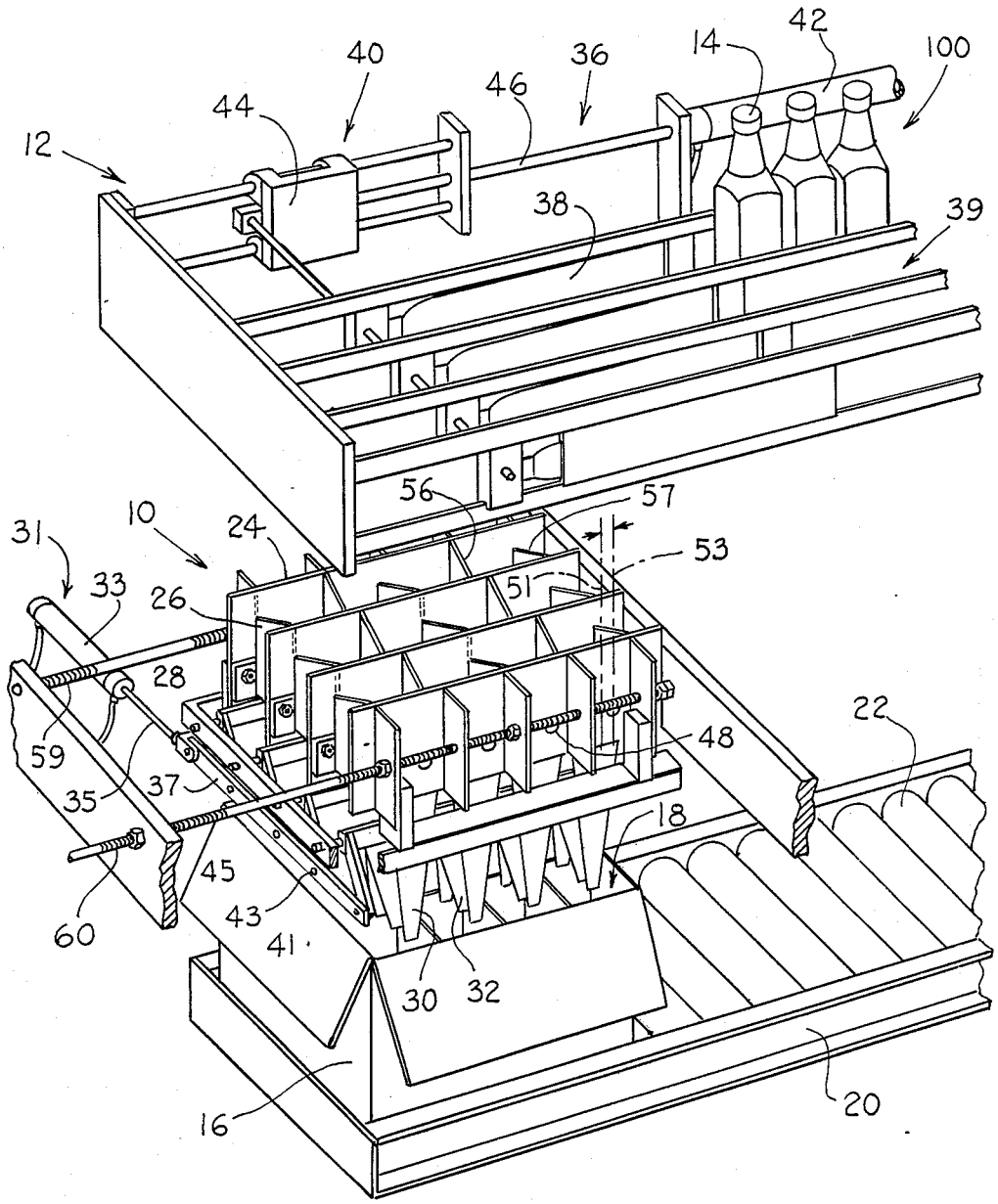
FIG. 1 is a perspective view of a preferred embodiment of grid structure having grid fingers and guide members constructed in accordance with the present invention.

Referring to the drawings in detail, wherein like reference characters represent like elements throughout the various views, a grid structure constructed in accordance with the present invention is shown in FIG. 1 and is designated generally by the reference character 10. Grid structure 10 is provided with a case packing machine, a portion of which is indicated generally as 12 in FIG. 1, for packing articles or containers 14 in aligned rows into a case 16 having empty compartments 18 therein. Case 16 is delivered below grid structure 10 by a conventional case conveyor 20 having a plurality of side-by-side conveyor rollers 22.

Figure 7:
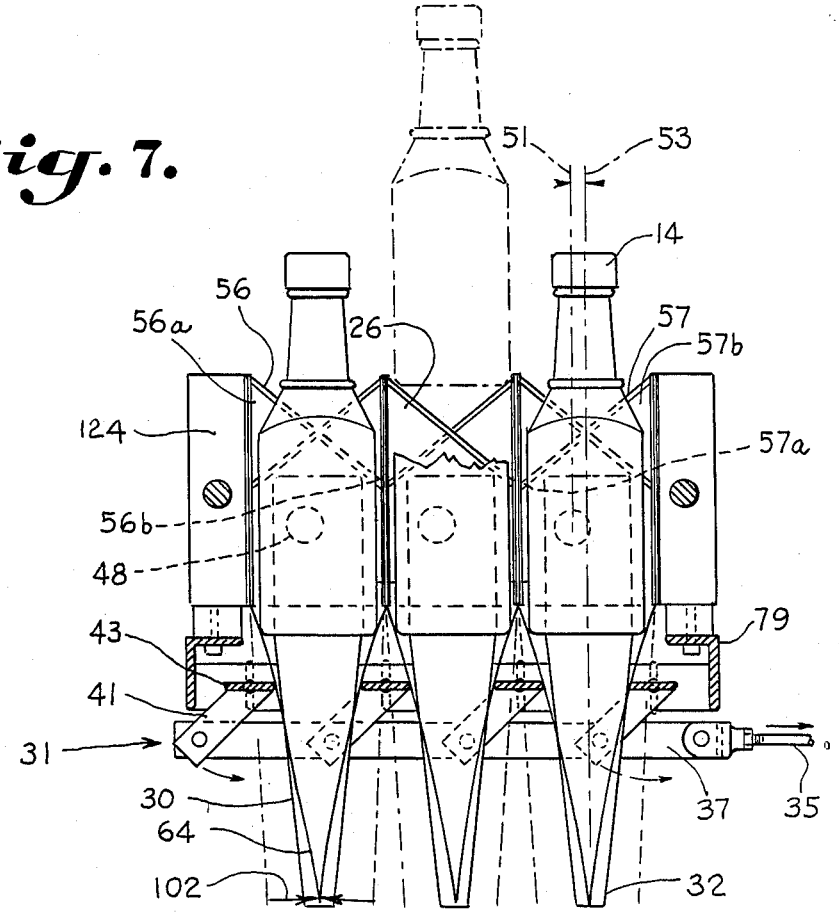
FIG. 7 is a medial sectional view of a grid structure as illustrated in FIG. 1 having a grid finger actuation system constructed in accordance with the present invention, wherein the grid finger actuation system has been actuated for moving the grid fingers to an article retaining position.
Figure 8:
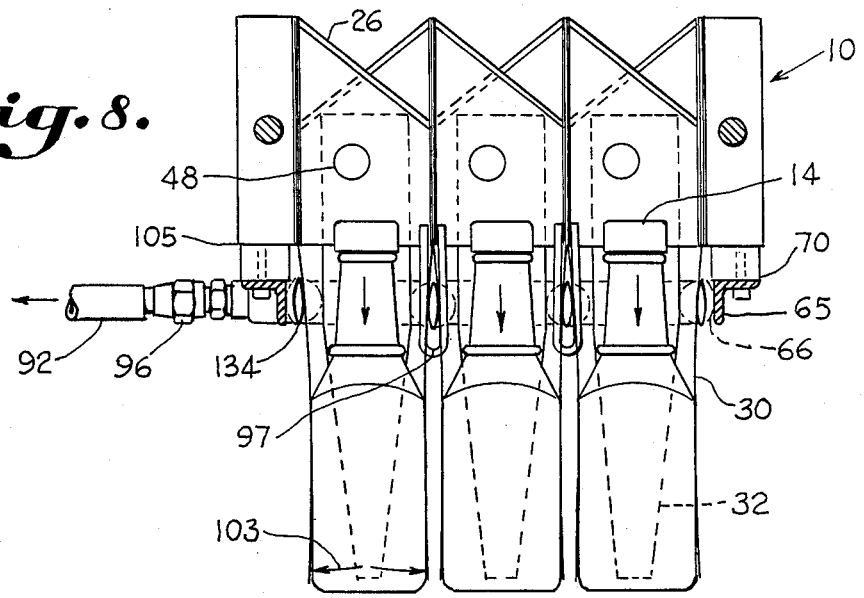
FIG. 8 is a medial sectional view of a grid structure as illustrated in FIG. 2 having alternate embodiment inflatable grid finger actuators, wherein the inflatable grid finger actuators are deflated for allowing the grid fingers to move to an article discharging position.

Grid structure 10 includes spaced apart elongated walls 24 and guide members or partitions 26 spaced along walls 24 defining passages, generally 28, through which containers 14 may pass for loading into a case 16. A plurality of downwardly extending movable grid fingers 30 are attached adjacent passages 28 and are movable between a container retaining position, as shown in FIG. 7, for retaining containers 14 in passages 28 and a container discharging position, as shown in FIG. 8, for allowing containers 14 to be discharged in aligned rows from passages 28. Movable elongated body members, or grid fingers 30, move between inwardly biased grid fingers 32, grid fingers 32 being attached at upper portions thereof to partitions 26. Grid structure 10 also includes an actuation system, generally 31, which moves grid fingers 30 between an article retaining position and an article discharging position. Actuation system 31 is disclosed in detail in U.S. Pat. No. 4,215,521, entitled "Article Retarding Device for Case Loading Machine", which is incorporated herein by reference. As discussed later and as illustrated in FIG. 7 and in FIG. 8, which shows alternate embodiment inflatable actuation members 34, grid fingers 30 are moved towards one another from opposite sides of a passage 28 by actuation system 31 to an article retaining position illustrated in FIG. 7 such that the passages 28 are closed off from permitting articles 14 to pass therethrough.

Actuation system 31 includes a cylinder 33 having a piston rod 35 pivotally connected to a bar 37. Pivotally connected to bar 37 are linkages 41, which are fixed to arms 43. Arms 43 are carried for rotation in and relative to support 45, and one arm 43 is disposed beneath each wall 24 adjacent the back sides of grid fingers 30. Upon retraction of piston rod 35, bar 37 moves with piston rod 35 to cause linkages 41 to pivot relative to bar 37 and support 45. This causes arms 43 to contact the backsides of grid fingers 30 and force grid fingers 30 inwardly towards one another to an article restraining position, as shown in FIG. 7. Upon extension of piston rod 35, bar 37 moves, and linkages 41 pivot for causing arms 43 to rotate away from grid fingers 32 and thus allow grid fingers 32 to move to an article discharge position, whereby articles 14 may fall from passages 28 into case 16.

Figure 2:
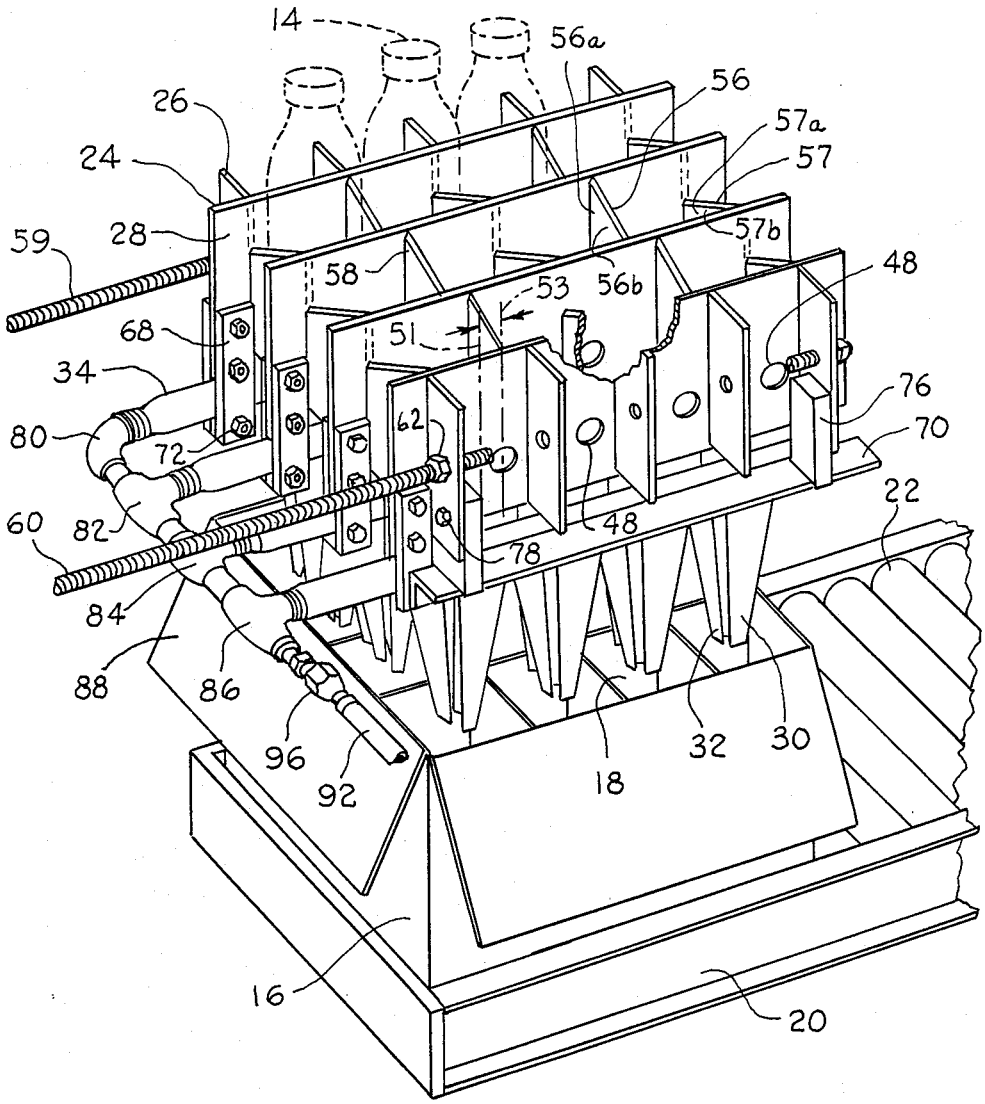
FIG. 2 is a perspective view of an alternate embodiment of a grid structure constructed in accordance with the present invention having guide members, grid fingers, and inflatable grid finger actuators constructed in accordance with the present invention.

An alternate embodiment of a grid finger actuation system 31 is illustrated in FIGS. 2 and 8 and includes inflatable actuation members 34 which are contactable with movable grid fingers 30 for effecting movement thereof. A more detailed description of inflatable actuation members 34 is disclosed in U.S. patent application Ser. No. 07/033,455, of which the present application is a continuation-in-part.

Inflatable actuation members 34 are inflatable between an inflated position, as shown in phantom in FIG. 8, for contacting and positioning movable grid fingers 30 in the article retaining position, and inflatable actuation members 34 are deflatable, as shown in solid lines in FIG. 8, for allowing movable grid fingers 32 to relax and move to the container discharging position illustrated in FIG. 8.

Case packing machine 12 delivers containers 14 from a conventional upstream supply source, such as a container sealing or labeling machine (not shown), by means of a reciprocating carriage assembly, generally 36, shown in FIG. 1. Reciprocating carriage assembly 36 includes longitudinally extending inflatable bladders 38 which inflate to grip containers 14 to reciprocating carriage assembly 36 when reciprocating carriage assembly 36 is moved upstream to encompass a group of aligned containers 14 in parallel lanes 39 of case packing machine 12. Upon encompassment of a group of containers 14 by reciprocating carriage assembly 36, the inflation of longitudinally extending bladders 38, and a corresponding gripping of containers 14 thereto, reciprocating carriage assembly 36 is advanced downstream with the group of aligned containers 14 by a reciprocating transport assembly, generally 40. Reciprocating transport assembly 40 includes a double-action fluid actuated cylinder 42 connected to a bearing block assembly, generally 44, which is attached directly to reciprocating carriage assembly 36. Upon movement of a piston rod 46 of cylinder 42, bearing block 44 is moved accordingly, as is reciprocating carriage assembly 36 connected to bearing block assembly 44. A more detailed description of reciprocating carriage assembly 36, longitudinally extending inflatable bladders 38, and reciprocating transport assembly 40 is disclosed in copending U.S. patent application Ser. No. 07/007,795, filed January 28, 1987, entitled, "Article Transport Apparatus", which is incorporated herein by reference and of which applicant is a co-inventor.

Figures 3, 4, 5, 6:
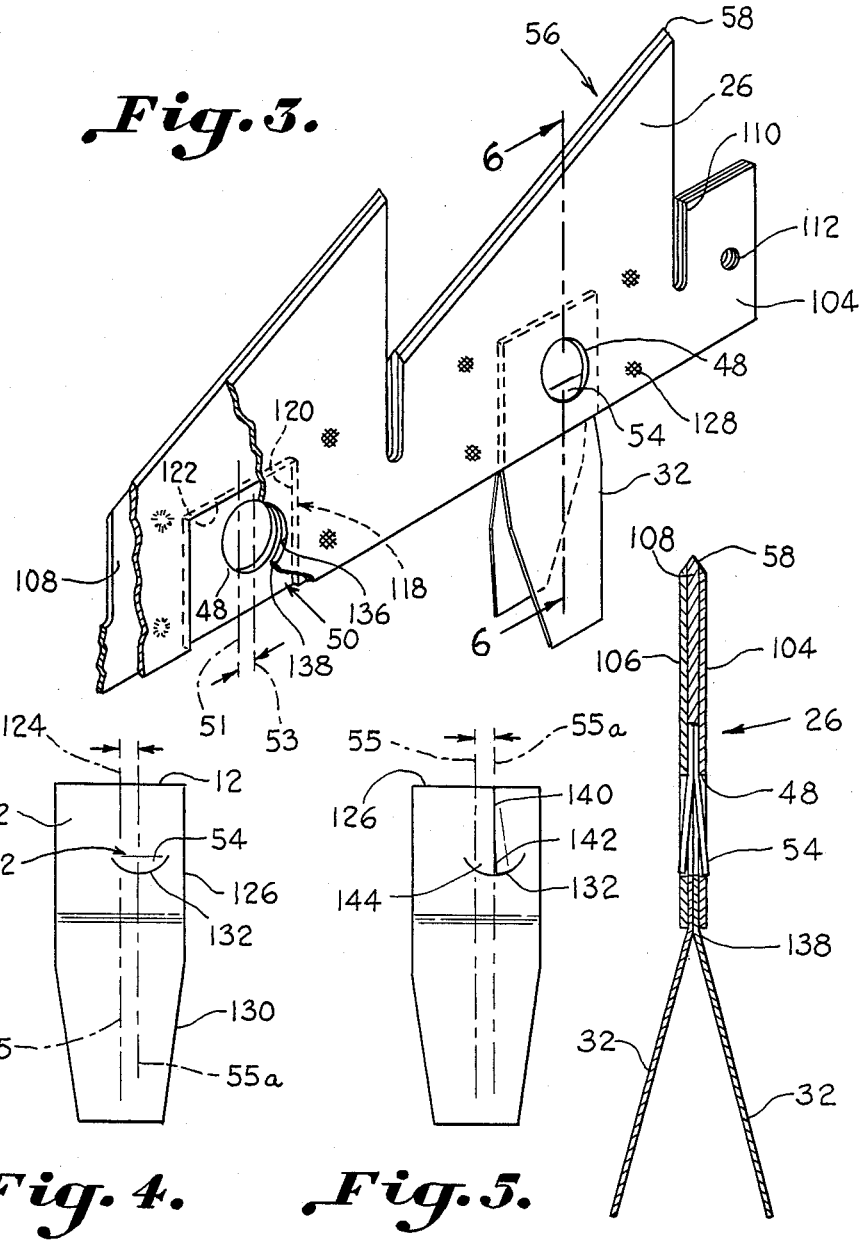
FIG. 3 is a partial perspective view of a guide member constructed in accordance with the present invention.
FIG. 4 is a side elevational view of a grid finger constructed in accordance with the present invention.
FIG. 5 is a side elevational view of an alternate embodiment of a grid finger constructed in accordance with the present invention.
FIG. 6 is a sectional view along lines 6—6 of FIG. 3.

Walls 24 of grid structure 10 have substantially planar surfaces and are generally rectangular in shape. Walls 24 and guide members 26 are preferably of laminated construction and act as receiving members which include apertures, generally 48, and recesses, generally 50, defined therein. A guide member 26 is illustrated in FIG. 3. Apertures 48 could be of a variety of shapes and are not limited to the round shaped apertures 48 shown in the drawings. A longitudinal axis 51 extends substantially vertically through a central portion of recesses 50. As illustrated by aperture axes 53 in the Figures, the centers of apertures 48 are positioned substantially to one side of axis 51 such that axis 51 does not extend through the centers of apertures 48.

An aperture 48 communicates with a receiving recess 50 provided in each wall 24 and each guide member 26 for passages 28. Recesses 50 receive upper ends 52 of grid fingers 30, 32. As illustrated in FIGS. 3, 4, and 5, upper end 52 of each grid finger includes a longitudinal axis 55 which extends substantially vertically along a central portion of upper end 52. An outwardly extending tab portion 54 is provided each upper end 52 of each grid finger 30, 32 and has an axis 55*a* positioned substantially on one side of longitudinal axis 55. Tab portions 54 could be of a variety of shapes and are not limited to the semicircular shaped tab portions 54 shown in the drawings. Tab portions 54 are compressible upon insertion of upper ends 52 into recesses 50. Because tab portions 54 are positioned substantially on one side of longitudinal axis 55, and because apertures 48 are likewise substantially positioned on one side of axis 51 of recess 50, upper ends 52 may be inserted into recesses 50 only when upper ends 52 are oriented such that tab portions 54 and apertures 48 are both positioned on the same side of axes 51, 55, respectively, and such that axis 53 of aperture 48 and axis 55*a* of the grid finger are in substantial alignment. If a grid finger 30, 32 is attempted to be inserted in an improper manner, i.e. when aperture 48 and tab portion 54 do not match up, the grid fingers 30, 32 will not readily become seated in recess 50, and tab portion 54 will not extend through aperture 48. However, upon proper insertion of an upper end 52 of a grid finger 30, 32 into a recess 50, the off-center tab portion 54 will become depressed and will extend outwardly through the off-center aperture 48 corresponding to the recess 50. The projection of the off-centered tab portion 54 through the off-center aperture 48 securely retains the grid finger 30, 32 within a recess 50 in a wall 28 or guide member 26.

Guide members 26 of grid structure 10 have planar surfaces as do walls 24 and also include oppositely angled upper edges 56, 57 for facilitating loading of containers 14 into passages 28. Guide members 26 are attached to walls 24 such that oppositely angled edges 56, 57 alternate with one another and such that passages 28 of a size corresponding to the size of containers 14 which are to be loaded are formed therebetween. Oppositely angled edges 56, 57 are illustrated in the Figures and serve to cause containers 14 which are delivered to grid structure 10 to be both separated from one another, if they are in contact, and to also be guided into passages 28 of grid structure 10. Oppositely angled edges 56, 57 are preferably of a 30°-35° angle with respect to walls 24, although oppositely angled edges 56, 57 could have other angles depending on the particular application and the desired results.

As shown in FIGS. 2, 7 and 8, oppositely angled edges 56, 57 each include first portions 56*a*, 57*a* spaced across passageway 28 from one another and second portions 56*b*, 57*b* spaced across passageway 28 from one another. Turning to FIG. 7, portions 56*a* and 57*b* are at approximately the same elevation; and portions 56*b* and 57*a* are at approximately the same elevation. As can be seen from the drawings, angled edge 56 extends upwardly from first portion 56*a* to second portion 56*b*, while angled edge 57 extends downwardly from first dropped downward and the bottoms of articles 14 contact against oppositely angled edges 56, 57, oppositely angled edges 56, 57 cause articles which are adjacent to one another to be moved slightly laterally in opposite directions with respect to one another. This lateral separation of articles 14 with respect to one another improves the ability to pack articles which are contacting one another when they are delivered to grid structure 10 in that as the articles 14 experience lateral separation, they are also channeled downwardly into passages 28. The lateral separation is facilitated by the upper surfaces 58 of oppositely angled edges 56, 57. Upper surfaces 58 are curved or angled inwardly towards each passage 28 adjacent each guide member 26 on which angled edges 56, 57 are provided. The angled upper surfaces 58 are for aiding in guiding articles 14 into the adjacent passages 28 in that angled upper surfaces 58 can "knife" between adjacent articles 14 and thus cause the articles to move away from one another upon impact on surfaces 58, and towards their proper passage 28.

Threaded attachment rods 59, 60 are provided in outer ends of guide members 26 for stabilizing and spacing guide members 26 apart from one another. Attachment rods 59, 60 may also be used for attaching grid structure 10 to an elevator mechanism (not shown) for lowering grid structure 10 to case 16 below. Nuts 62 are provided on attachment rods 59, 60 and serve to aid in fixing guide members 26 with relation to one another.

Grid structure 10 is preferably constructed of stainless steel, although any other suitable material could be used. Assembly of the elongated partitions 24 and guide members 26 could be accomplished by welding, nut and bolt fasteners, or by any other suitable fastening means.

Biased grid fingers 32 are preferably constructed of spring steel and are bent so that they are permanently biased inward beneath passages 28. Movable grid fingers 30 are also preferably constructed of spring steel, although any other suitable metal, plastic or other material could also be used to construct grid fingers 30, 32.

Movable grid fingers 30 may be substantially flat, or bent so as to extend inwardly towards one another beneath passages 28. If movable grid fingers 30 are flat, actuation system 31 or inflatable actuation members 34 bend them, upon actuation thereof, inwardly towards one another beneath passages 28. Upon deactuation of actuation system 31 or deflation of inflatable actuation members 34, the originally flat movable grid finger 30 would return to their normally flat profile. When movable grid fingers 30 are moved to the article retaining position illustrated in FIG. 7 by actuation system 31 or inflatable actuation members 34, movable grid fingers 30 move between biased grid fingers 32 such that movable grid fingers 30 opposite one another about a particular passage 28 contact each other at lower end portions 64 thereof.

Inflatable actuation members 34 are preferably elongated elastic tubes, generally 65, having peripheral portions 66 which expand upon inflation of inflatable actuation members 34 by compressed air or by any other suitable pressurized fluid. As illustrated in FIGS. 2 and 8, inflatable actuation members 34 are provided below each elongated partition 24 and are held there by end clamp members 68 and lateral clamp members 70. As best shown in FIG. 2, end clamp members 68 are elongated clamp members, while lateral clamp members 70 are elongated angle members. Bolt and nut combinations 72 hold end clamp members 68 and inflatable actuation members 34 therebetween to elongated partitions 24. Mounting blocks 76 are provided in the corners of grid structure 10 and are bolted to guide members 26 by bolts 78. Bolts 79 attach lateral clamp members to mounting blocks 76.

Inflatable actuation members 34 are connected to conduit supply members 80, 82, 84, and 86. Conduit supply members 80, 82, 84, and 86 are interconnected by tube members 88. Conventional hose clamps attach inflatable actuation members 34 to conduit supply members 80, 82, 84, and 86. A supply/exhaust conduit 92 connects inflatable actuation members 34 to a valve (not shown), which may be solenoid-actuated. Another supply/exhaust conduit (not shown) is also connected to the valve and to a source of pressurized air. Conventional tube and/or hose fittings 96 are provided for assembling together conduit supply members 80, 82, 84, and 86, tube members 88, and supply/exhaust conduit 92. An apparatus and system for inflating and deflating inflatable actuation members 34 may be of the type described in co-pending U.S. patent application Ser. No. 07/007,795, filed Jan. 28, 1987, as already incorporated hereinabove.

U-shaped wire members 97 are provided at the interior intersections of elongated partitions 24 and guide members 26 for encompassing and retaining inflatable actuation members 34 adjacent the lower end of elongated partitions 24. U-shaped wire members 97 can be attached to elongated partitions 24 and guide members 26 by welding or by any other suitable fastening means.

Turning to the operation of grid structure 10, containers 14 are first picked up in aligned rows at a container receiving station 100 by reciprocating carriage mechanism 36, upon the inflation of longitudinally extending inflatable bladders 38. Reciprocating carriage assembly or mechanism 36 is then moved downstream by piston rod 46 of double-action fluid actuated cylinder 42 acting on bearing block 44. Upon the aligned rows of containers 14 being positioned above grid structure 10, piston rod 35 of double action cylinder 33 of actuation system 31 is retracted to cause arms 43 to rotate in support 45 and contact the backsides of movable grid fingers 30, thereby forcing lower end portions 64 of movable grid fingers 30 together to the container retaining position illustrated by arrows 102 in FIG. 7. Or, in the alternate embodiment, inflatable actuation members 31 could be inflated to contact the backsides of movable grid fingers 30 and move them to the container retaining position. Longitudinally extending inflatable bladders 38 are deflated such that containers 14 fall into passages 28 of grid structure 10. Containers 14 are retained in grid structure 10 due to movable grid fingers 30 being in the container retaining position. Grid structure 10 is then lowered adjacent case 16, or, in the alternative, case 16 may be brought up towards grid structure 10, and actuation system 31 is deactuated by the extension of piston rod 35, which causes arms 43 to rotate such that fingers 30 move away from one another. In the alternate embodiment, inflatable actuation members 34 are deflated. The deactuation of actuation system 31 or the deflation of inflatable actuation members 34 allows movable grid fingers 30 to move outwardly from below passages 28 in the direction of arrows 103 to the container discharging position illustrated in FIG. 8. Upon movable grid fingers 30 moving to the container discharge position, containers 14 pass from passages 28 in the direction of arrows 105 and are guided by movable grid fingers 30 and biased grid fingers 32 into compartments 18 of case 16. Meanwhile, reciprocating carriage mechanism 36 moves upstream adjacent container receiving station 100 for picking up another group of containers 14.

Grid structure 10 utilizes movable grid fingers 30 to retain containers 14 dropped into grid structure 10 from passing on through passages 28. The biasing together of movable grid fingers 30 by actuation system 31 or by inflatable actuation members 34 reduces the abrupt impact forces generated when containers 14 are dropped into grid structure 10, as compared to conventional drop bar assemblies. Not only does this result in less breakage and damage to containers 14, it also allows for quieter operation of grid structure 10 and, accordingly, case packing machine 12.

In the alternate embodiment, the retaining of the containers in grid structure 10 and the allowance of discharge therefrom is accomplished primarily by the inflation and deflation of inflatable actuation members 34 acting in conjunction with movable grid fingers 30. The frictional contact of movable grid fingers 30 with the containers can be varied to control of the dropping of the containers from grid structure 10 by adjusting the rate of deflation of the inflatable actuation members 34.

Referring to FIGS. 3 and 6, guide members 26 are of a laminated construction include longitudinally extending slat members 104, 106 separated from one another by longitudinally extending spacer members 108. Walls 24 are preferably of substantially the same laminated construction. It is to be understood that guide members 26 and walls 24 could be of other than laminated construction and could be casted, molded, machined, etc. into the desired form.

Slat members 104, 106 and spacer members 108 are preferably constructed of steel, although any suitable metal, plastic, or other material could be used, and are held together by welds 128. Slat members 104, 106 and spacer members 108 are provided with cooperating slots 110 which receivingly engage slots 110 of perpendicularly extending slat members 104, 106 and spacer members 108 of walls 24 or guide members 26 for forming grid structure 10 having compartments 28, as shown in FIGS. 1 and 2. Slat members 104, 106 are also provided with holes 112 for attachment with bolts (not shown) to vertical frame members (not shown) of the case packing machine 12.

Spacer members 108 are provided with substantially rectangular cut-out portions 118, shown by the phantom lines in FIG. 3, for receiving the upper end 52 of grid fingers 30. Cut-out portions 118 each include side surfaces 120 and upper surfaces 122 for defining receiving recesses 50, which receive the upper end 52 of grid fingers 30. Upper surfaces 122 of cut-out portions 118 are contactable with upper edges 124 of grid fingers 30 for restraining upward movement of grid fingers 30 within receiving recesses 50, and side surfaces 120 are contactable with side edges 126 of grid fingers 30 for preventing lateral movement of the upper ends 52 of grid fingers 20 within receiving recesses 50.

Grid fingers 32 each include a lower end 130 which is angled with respect to upper end 52 such that the lower end 130 of a grid finger 32 projects below a compartment 28 of grid structure 10 for guiding containers 14 into a compartment of a case 16 disposed beneath grid structure 10, as shown in FIGS. 1 and 2. In the embodiment illustrated in FIG. 4, grid fingers 30 and 32 are constructed of sheet steel, and compressible resilient member or tab 54 includes a semi-circular or crescent slot 132. Crescent slot 132 allows for a compressible engagement member, generally 134, or tab 5 to be formed in upper end 52 through the bending outward of the portion of upper end 52 adjacent crescent slot 132.

Grid fingers 30, 32 are attachable to walls 24 and guide members 26 through receipt of upper end 52 of grid fingers 30, 32 by receiving recesses 50 thereof. The upper end 52 of a grid finger 30, 32 is insertible in a receiving recess 50, and upon insertion of upper end 52 into receiving recess 50, the compressible engagement member 134 of the grid finger 30, 32 is received by aperture 48 and projects outwardly therethrough. Compressible engagement member 134 engages surfaces 136 of slat members 104, 106 which surround and define apertures 48 therein. Projection of compressible engagement member 134 through aperture 48 effectively retains grid finger 30, 32, to walls 24 and guide members 26.

Upon insertion of upper end 52 of a grid finger 30 into a receiving recess 50, a border portion 138 defining the entrance to receiving recess 50 engages compressible engagement member 134 to flatten compressible engagement member 134 into upper end 52 of grid finger 30, 32, thereby making upper end 52 of grid finger 30, 32 substantially planar for allowing insertion of upper end 52 into receiving recess 50. As compressible engagement member 134 clears surfaces 136 surrounding aperture 48, compressible engagement member 134 springs outwardly from upper end 52 and engages with surfaces 136 as discussed above, and as shown in FIG. 6. Because the projection of compressible engagement member 134 preferably does not extend past the outward surfaces of slat members 104, 106 surrounding apertures 48, the attachment means of the present grid fingers do not stick outwardly into passages 28 in a manner which interferes with the smooth passing of articles 14 through grid structure 10.

Grid structure 10 of the present invention accordingly provides a low profile grid finger attachment arrangement substantially free of protuberances or projections which would inhibit the passage of a container 14 therethrough. Further, grid structure 10 also provides readily changeable, thin grid fingers 30, 32 which can be inserted between the wall of a rectangular container and a wall of a case partition member.

FIG. 5 illustrates an alternate embodiment of a grid finger 30 constructed in accordance with the present invention having a longitudinally extending slot 140 which terminates in crescent slot 132. Corners 142 are created at the intersection of longitudinally extending slot 140 and crescent slot 132, which are bendable outwardly from upper end 52 of the grid fingers for creating compressible engagement members, generally 144.

In removing a grid finger 30, 32 from walls 24 and guide members 26, compressible resilient members or tabs 54, 56 are depressed by had or by another device to become substantially flush with upper end 52 of grid finger 30, 32. A grid finger 30, 32 may then be pulled downwardly and removed from receiving recess 50. Another grid finger 30, 32 may then be inserted into the receiving recess 50. As shown in FIGS. 3 and 6, two grid fingers 32 may be inserted back-to-back in each receiving recess 50 for extending beneath adjacent compartments 28 of grid structure 10.

While the preferred embodiment of the invention has been described using specific terms, such description is for present illustrative purposes only, and it is to be understood that changes and variations to such embodiment, including but not limited to the substitution of equivalent features or parts, and the reversal of various features thereof, may be practiced by those of ordinary skill in the art without departing from the spirit or scope of the following claims.

What is claimed:

1. A grid structure for use on a case packing machine for packing articles in aligned rows into cases, the grid structure comprising:

elongated members for allowing the articles to be positioned in aligned rows and being spaced apart sufficiently for allowing the articles to pass therebetween;

guide members spaced along said elongated members for defining passages through which the articles may pass for loading into the cases, said guide members including a first guide member positioned adjacent a first passage, said first guide member having a first portion and a second portion spaced from said first portion, said first guide member defining a first inclined portion extending upwardly from said first portion to said second portion of said first guide member, said guide members also including a second guide member spaced from said first guide member by said first passage, said second guide member having a first portion and a second portion spaced from said first portion thereof, said first and second portions of said second guide member being spaced across from said first and second portions of said first guide member, respectively, by said first passage; said second guide member defining a second inclined portion extending downwardly from said first portion to said second portion of said second guide member, such that when articles are supplied to the grid structure, the articles are contactable with said first and second inclined portions, and the articles are separated and guided into adjacent passages in the grid structure by said first and second inclined portions;

downwardly extending grid fingers attached adjacent said passages and movable between an article retaining position for retaining the articles in said passages and an article discharging position for allowing the articles to be discharged from said passages; and actuation means contactable with said grid fingers for effecting movement of said grid fingers between said article retaining position and said article discharging position.

2. A grid structure as set forth in claim 1, wherein said grid fingers include:

inwardly biased fingers extending inwardly below said passages, said inwardly biased fingers being spaced across from and inwardly biased towards one another about said passages; and movable fingers movable inwardly below said passages, said movable fingers being spaced across from one another about said passages; said movable fingers being movable inwardly by said actuation means from said article discharging position towards one another and between said inwardly biased fingers to said article retaining position.

3. A grid structure as set forth in claim 1, wherein said actuation means is inflatable between an inflated position for positioning said grid fingers in said article retaining position and deflatable for allowing said grid fingers to move to said article discharging position.

4. A grid structure as set forth in claim 3, wherein said actuation means includes a longitudinally extending, inflatable member which expands upon inflation for contacting said grid fingers and for moving said grid fingers to said article retaining position.

5. A grid structure as set forth in claim 1, wherein said actuation means includes:

a support member associated with said grid structure;

arms extending adjacent said grid fingers and mounted for rotation in said support member, said arms being rotatable between a position for holding said grid fingers at said article retaining position and a position for allowing said grid fingers to move to said article discharging position; and means connected to said arms for rotating said arms relative to said support.

6. A grid structure as set forth in claim 5, wherein said means for rotating said arms includes:

a cylinder having a piston rod, said piston rod being retractable into and extendable from said cylinder; and a linkage assembly connected to said piston rod for rotating said arms upon movement of said piston rod.

7. A grid structure as set forth in claim 1, wherein said grid fingers include:

a plurality of downwardly extending elements inwardly biasable below said passages; and a flexible resilient portion provided each of said plurality of downwardly extending elements, said flexible resilient portion being adapted for resiliently contacting bottom portions of the articles upon receipt thereof by said passages when said grid fingers are in said article retaining position.

8. A grid structure as set forth in claim 7, wherein each of said plurality of downwardly extending elements includes:

an elongated body member having an upper end and a lower end; and an outwardly projecting tab portion extending from said upper end of said elongated body member; and wherein the grid structure defines apertures adjacent said passages for receiving said outwardly projecting tab portion of each of said plurality of elongated body members for retaining said plurality of downwardly extending elements to the grid structure.

9. A grid structure as set forth in claim 1, further comprising:

said grid structure defining openings adjacent said passages and apertures in communication with said openings;

said downwardly extending elements including an elongated body member having an upper end receivable in one of said openings of the grid structure adjacent one of said passages; and a compressible resilient member projecting from said elongated body member proximate said upper end of said elongated body member, said compressible resilient member being receivable in and projectable through one of said apertures of the grid structure only when said elongated body member is positioned for guiding articles supplied to the grid structure through said passage, such that upon receipt by the grid structure of said upper end of said elongated body member and said compressible resilient member, said compressible resilient member projects through said aperture for fixedly retaining said elongated body member to the grid structure.

10. A grid structure as set forth in claim 9, wherein said upper end of said elongated body member includes a central longitudinal axis, wherein said compressible resilient member is provided on said upper end of said elongated body member, and wherein a major portion of said compressible resilient member is positioned on one side of said central longitudinal axis.

11. A grid structure for delivering articles from an article supply source to compartments in containers, the grid structure comprising:

a plurality of guide members attached to one another to define a plurality of passageways therebetween, said guide members including a first guide member positioned adjacent a first passageway, said first guide member having a first portion and a second portion spaced from said first portion, said first guide member defining a first inclined portion extending upwardly from said first portion to said second portion of said first guide member, said guide members also including a second guide member spaced from said first guide member by said first passageway, said second guide member having a first portion and a second portion spaced from said first portion, said first and second portions of said second guide member being spaced across from said first and second portions of said first guide member, respectively, by said first passageway; said second guide member defining a second inclined position extending downwardly from said first portion to said second portion of said second guide member such that when articles are delivered to the grid structure, the articles are contactable with said first and second inclined portions, whereby the articles are separated and guided into adjacent passageways in the grid structure by said first and second inclined portions.

12. A grid structure as set forth in claim 11, wherein said first inclined portion of said first guide member and said second inclined portion of said second guide member define transversely extending angled portions which are inclined towards said first passageway, said transversely extending angled portions acting to guide the articles delivered to the grid structure into said first passageway.

13. A grid structure as set forth in claim 11, wherein said first portion of said first guide member and said second portion of said second guide member extend upwardly to approximately the same elevation, and wherein said second portion of said first guide member and said first portion of said second guide member extend upwardly to approximately the same elevation.

14. A grid structure as set forth in claim 11, wherein said first and second inclined positions define angled edge portions contactable with the articles.

* * * * *